US008413599B2

(12) United States Patent
Underwood

(10) Patent No.: US 8,413,599 B2
(45) Date of Patent: Apr. 9, 2013

(54) LOW PROFILE TETHERING DEVICE FOR SECURING A BOAT

(76) Inventor: Rock Underwood, Chapin, SC (US)

( * ) Notice: Subject to any disclaimer, the term of this patent is extended or adjusted under 35 U.S.C. 154(b) by 0 days.

(21) Appl. No.: 12/994,001

(22) PCT Filed: May 15, 2009

(86) PCT No.: PCT/US2009/044236

§ 371 (c)(1),
(2), (4) Date: Feb. 28, 2011

(87) PCT Pub. No.: WO2009/143029

PCT Pub. Date: Nov. 26, 2009

(65) Prior Publication Data

US 2011/0146557 A1 Jun. 23, 2011

Related U.S. Application Data

(60) Provisional application No. 61/055,294, filed on May 22, 2008.

(51) Int. Cl.
*B63B 21/00* (2006.01)

(52) U.S. Cl. ..... 114/230.2; 114/230.23

(58) Field of Classification Search ..... 114/218, 114/230.2, 230.22, 230.23, 230.26
See application file for complete search history.

(56) References Cited

U.S. PATENT DOCUMENTS 4,278,042 A * 7/1981 Lindquist ..... 114/218
4,697,537 A * 10/1987 Smith ..... 114/230.23
4,846,090 A * 7/1989 Palmquist ..... 114/230.23
5,931,112 A * 8/1999 Lacan ..... 114/218
7,325,509 B2 * 2/2008 Gordon et al. ..... 114/230.23

FOREIGN PATENT DOCUMENTS

JP 10-183578 A 7/1998
KR 10-0607881 B1 8/2006
WO WO 01-02241 A1 1/2001

OTHER PUBLICATIONS

Search Report from Corresponding PCT Application, Jan. 11, 2010.
Webpage ezCLEAT from http://ezcleat.com/gallery.html dated Apr. 19, 2011.
Webpage linedudes from http://linedudes.com/ dated Apr. 19, 2011.
Webpage Worth Company 19000 Moormate Marine Recessed Boat Cleat With Retractable Rope from http://www.amazon.com/Worth-Company-19000-Moormate-Retractable/dp/B0000AZ7GE dated Apr. 19, 2011.

* cited by examiner

*Primary Examiner* — Stephen Avila
(74) *Attorney, Agent, or Firm* — Michael A. Mann; Nexsen Pruet, LLC

(57) ABSTRACT

A tethering device for a boat may be mounted to a dock so that the top surface of the tethering device is flush with the top of the dock. Inside the housing is a retraction reel storing a sufficient length of line to provide tethering of the boat to the dock while retracting excess line back for out-of-sight storage but leaving the pre-selected length of line extending from the tethering device. The housing also has a line locking mechanism to hold the line at the pre-selected length so as to prevent the boat from drifting away taking line with it.

16 Claims, 6 Drawing Sheets

LOW PROFILE TETHERING DEVICE FOR SECURING A BOAT

PRIORITY CLAIM

Priority to U.S. provisional patent application 61/055,294 filed May 22, 2008, which is incorporated herein in its entirety by reference, is claimed.

BACKGROUND OF THE INVENTION

The present invention relates to devices for tethering watercraft, boats in particular, to docks. Currently, the most common way for a boat to be secured to a dock is to wrap a rope from a boat around a cleat fastened to the dock surface. A cleat is a device bolted to the surface of the dock and has two prongs extending laterally from opposing sides of the base. A rope may be looped in a figure eight pattern or lashed in some other manner around the two opposing prongs.

There are several shortcomings in the use of cleats. Primarily the cleats together with a mass of rope used to tether the boat are a tripping hazard to those walking on the dock. This is ironic in view of the care generally taken on boats to eliminate tripping hazards. Also, the boat is only as secure as the extent to which the cleat is bolted to the dock. As docks weather, the security of the cleat's moorings becomes an insidious issue because the cleat looks secure but the wood holding it may have rotted. Finally, there is typically excess rope that is often casually coiled around the cleat. Thus there remains a need for a better way to tether a boat to a dock.

SUMMARY OF THE INVENTION

The present invention is a tethering device for a boat. The top surface of the tethering device is flush with the top of the dock and it is secured to the underside of the decking so that someone can walk on top of the decking without tripping. Inside the housing of the device is a retraction reel storing a sufficient length of line to provide tethering of the boat to the dock while retracting excess line for out-of-sight storage while leaving the pre-selected length of line extending from the tethering device. The housing also has a line locking mechanism to hold the pre-selected length of line and prevent the boat from drifting away taking the line with it.

The present tethering device is made to be fastened to the underside of the decking of the dock rather than to the top side of the decking so the part of the decking that holds it is not the sun and rain exposed surface. Also, securement of the tethering device is spread over several decking boards to better distribute the load.

The low-profile, flush upper surface of the device eliminates the tripping hazard of cleats, and the retraction reel eliminates the mass of excess line. The result is a neater appearance and certainly safer than the use of prior art cleats.

The internal line locking mechanism helps to assure that the line is securely fastened and remains securely fastened to the device at the length predetermined by the user.

These and other features and their advantages will be readily apparent to those skilled in the art in tethering small craft to docks and marinas from a careful reading of the Detailed Description of Preferred Embodiments, accompanied by the following drawings.

BRIEF DESCRIPTION OF THE DRAWINGS

In the figures.

DETAILED DESCRIPTION OF PREFERRED EMBODIMENTS

Figure 1:
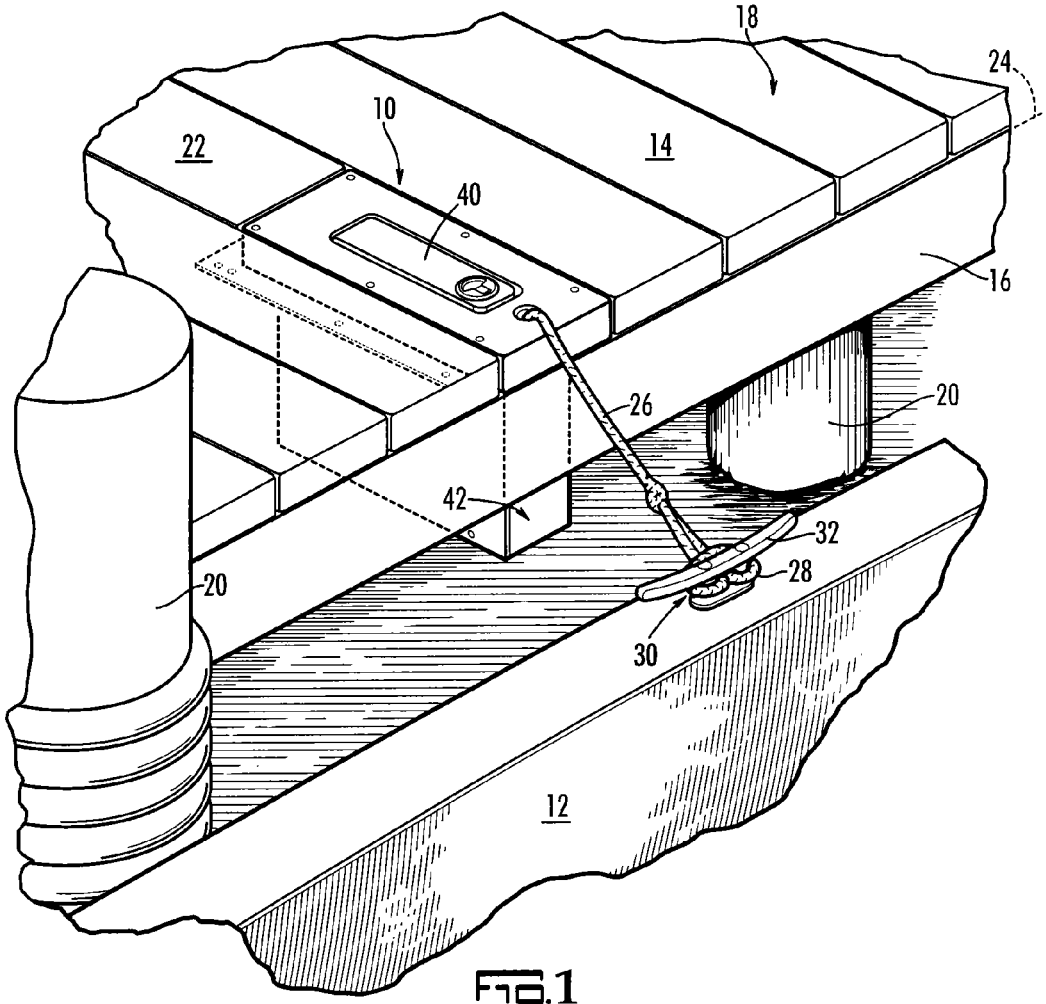
FIG. 1 is a left side perspective view of a dock with a boat tethered to a tethering device, according to a preferred embodiment of the present invention.
Figure 2:
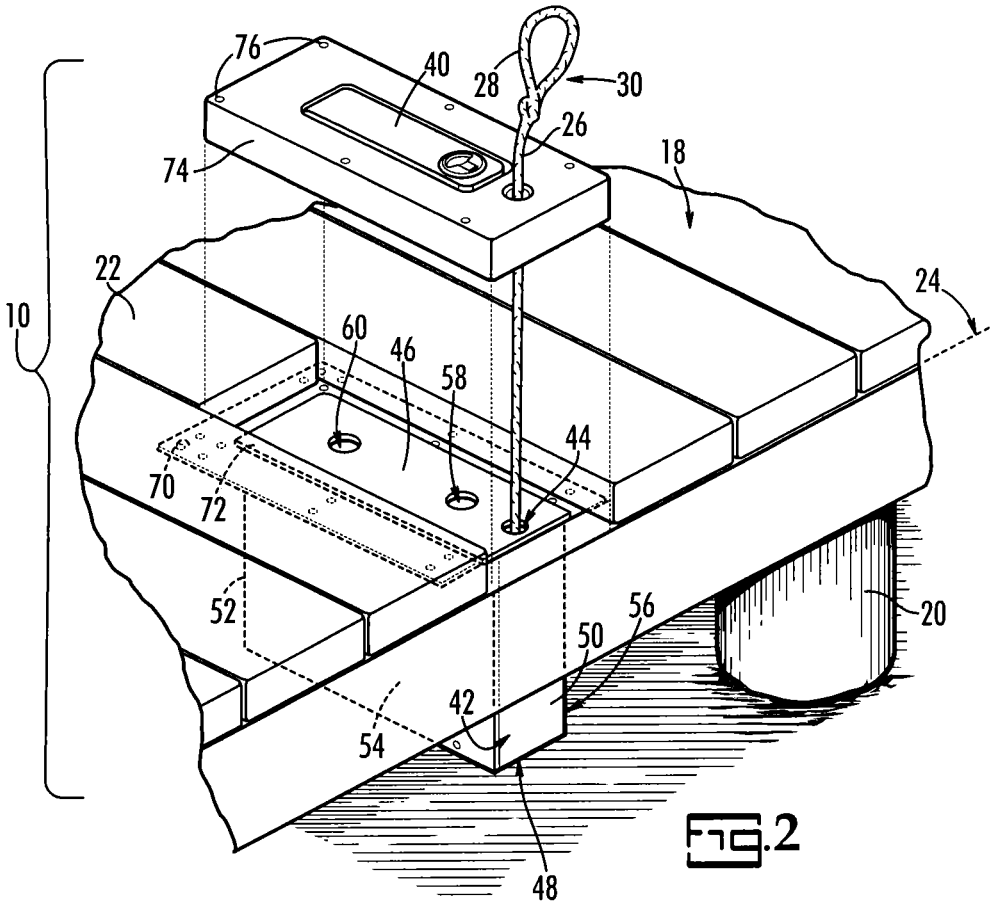
FIG. 2 is a detail of the view of FIG. 1 with the dock board of the tethering device shown lifted to reveal the mounting plate and housing, according to a preferred embodiment of the present invention.

As illustrated in FIGS. 1 and 2, the present invention is a device 10 for tethering a boat 12 or other water craft to a dock 14. A dock is a framework 16 covered with decking 18 and that extends from a shoreline out over the water where it may be supported by pilings 20, as shown, or may be a floating dock, to allow those with boats floating on the water to walk between shore and boat 12 easily. Boat 12 is tethered to dock 14 so that it is kept proximate to dock 14 and does not float away.

Decking 18 may be made of lumber such as 2×6 pine boards laid in parallel across framework 16 and fastened with nails or screws, or made of plastic, composite, metal, concrete or a combination of materials. The present device 10 may be incorporated into the surface of the dock or, as shown, made to replace a short section of the end of one decking board 22 and may be flush with the top of decking 18 so that it does not present a tripping hazard. Dock 14 may have several of the present devices installed along its edge 24 at intervals depending on how long dock 16 is and how many boats 12 may be tied up to dock 16. A marina dock may have a device 10 every 20 feet for example. Each device 10 has a line 26 that may have a loop 28 formed in the running end 30 thereof, preferably a spliced line loop for use in hitching line 26 to a cleat 32 on boat 12 using, for example, a lark's head hitch as illustrated in FIG. 1.

Device 10 is intended to provide a length of line 26 for use in tethering boat 12 to dock 14. Device 10 may be installed into dock 14 so that it holds running end 30 of line 26 at the dock's edge 24. The user simply unlatches a latch arm 40 on device 10 by raising it in order to release line 26, meaning, to cause device 10 to release its hold on line 26 so that running end 30 can be pulled away from device 10. The user may then pull a pre-selected amount of line 26 sufficient to reach boat 12 where loop 28 of the running end 30 may be attached to a cleat 32 or to another part of the boat 12. As will be explained herein, device 10 retracts the slack in line 26. When latch arm 40 is lowered to the latched position, device 10 grips line 26 so boat 12 cannot drift away from dock 16 beyond the pre-selected length of line 26 extending from device 10 when latch arm 40 was placed in the latched position. Latch arm 40 is shown in FIGS. 1 and 2 in the latched position, which is flush with the top of device 10 and decking 18. No part of device 10 extends significantly above decking 18 so as to present a tripping hazard and there is no pile of rope to clutter dock 14.

Figure 3:
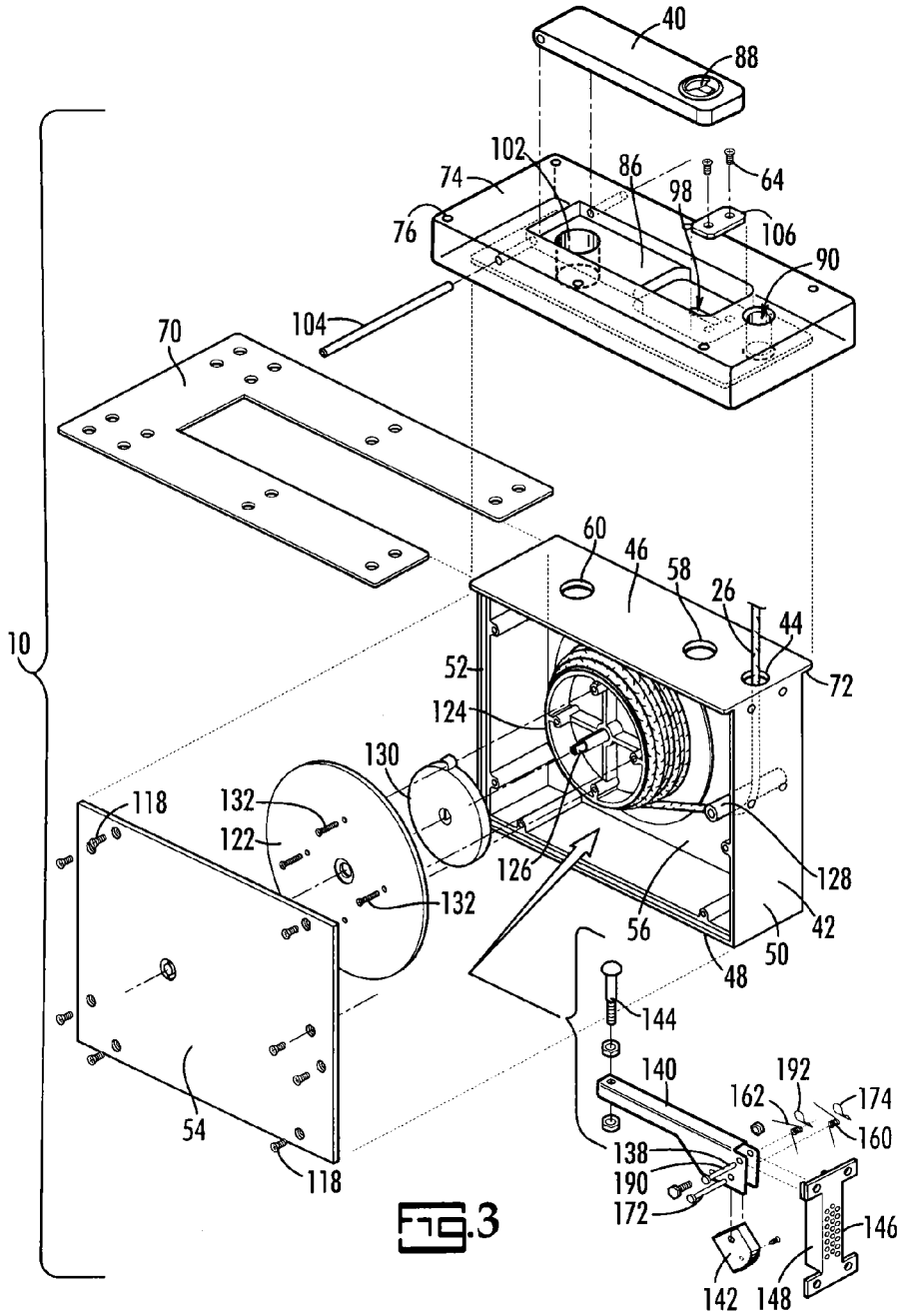
FIG. 3 is a left side perspective, exploded view of the present tethering device according to a preferred embodiment of the present invention.

Device 10 includes a housing 42 that may have six sides defining a rectangular parallelepiped as shown in FIGS. 2 and 3. Housing 42 has a hole 44 formed in one side which side is designated herein for convenience as top side 46 when device 10 is oriented as shown in FIG. 1. Top side 46 of housing 42 opposes a bottom side 48 of housing 42. Hole 44 will be located in top side 46 near a proximal side 50 as opposed to near a distal side 52. Proximal side 50 is intended to be parallel to and close to edge 24 of dock 16, when device 10 is installed in a preferred location of dock 16, so that line 26 issues from hole 44 at a point closest to edge 24 and boat 12 to limit the amount of line 26 on decking 18. Housing 42 has a first or left side 54 as seen in FIGS. 1-4, and an opposing second or right side 56. Top side 46 has two additional holes formed therein, a first proximal hole 58 and a second distal hole 60, the purposes of which will be explained presently.

Figure 4:
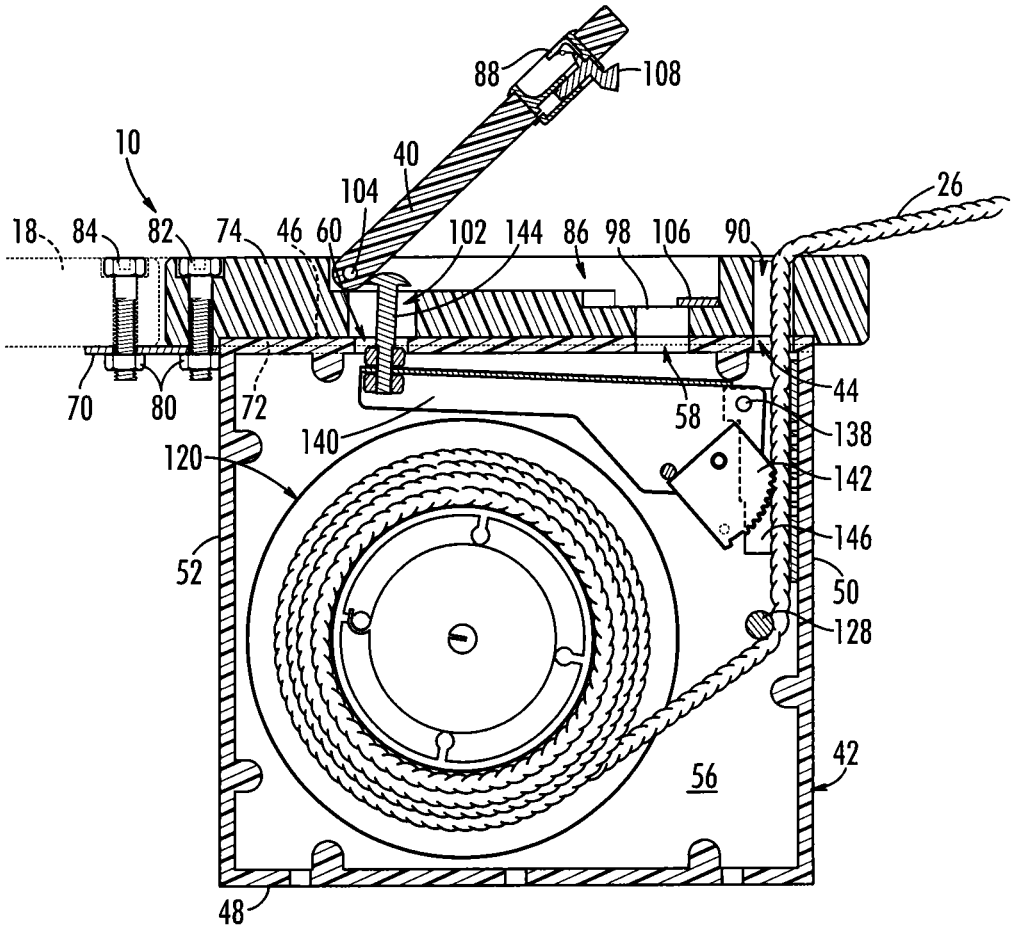
FIG. 4 is a left side, cross sectional view of the tethering device with latch arm lifted, according to a preferred embodiment of the present invention.

Housing 42 is supported from above by a U-shaped adaptor plate 70 that is fastened to the underside of decking 18 so that housing 42 is above the water line in order to avoid the impact of water on housing 42 and its internal structures. Top side 46 of housing 42 is formed with a flange 72 that rests on adaptor plate 70. When housing 42 is in position on adaptor plate 70, top side 46 is below the top surface of decking 18. A dock board 74 is then attached to adaptor plate 70 over flange 72 using bolts. Preferably, adaptor plate 70 includes pre-attached floating nut plates 80 so that the user merely needs to drill holes through decking 18 and decking board 22 from the surface of decking 18 and decking board 22 and then install bolts through the pre-drilled holes. Holes are formed in dock board 74 (FIGS. 2 and 3) and adaptor plate 70 to allow adaptor plate 70 to be secured to dock board 74 and adaptor plate 70 to decking 18, using bolts 82 and 84, respectively (FIG. 4). Dock board 74 has a thickness and a width that matches the thickness and width of the boards that comprise decking 18 so that device 10 can be installed merely by removing a portion of one decking board 22 near edge 24, installing adaptor plate 70 to the underside of surrounding, remaining decking 18, positioning flange 72 of housing 42 on adaptor plate 70, positioning dock board 74 over housing 42 and then securing dock board 74 to adaptor plate 70 with flange 72 sandwiched therebetween with bolts 82, and decking 18 to adaptor plate 70 with bolts 84, and the top surface of dock board 74 will be flush with the surrounding decking 18. Preferably the fastening bolts 82, 84 are counter-sunk so that no part of device 10 extends above decking 18 but rather is all essentially flush with decking 18.

Figures 5A, 5B:
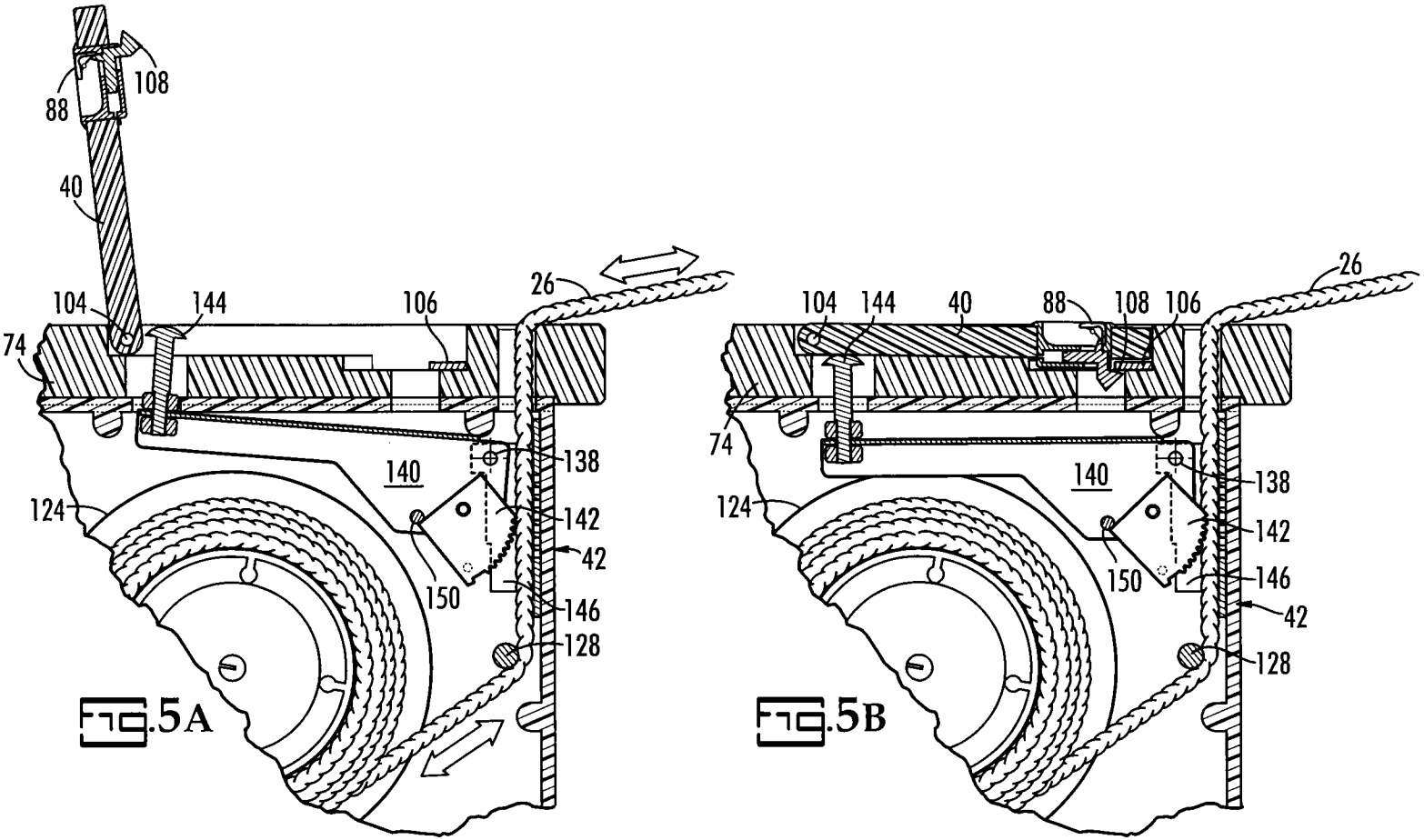
FIGS. 5A and 5B are left side, cross sectional views of a portion of the present tethering device with latch arm in the unlatched (raised) position and in the latched (lowered) position so that the impact of the latch on the cam's ability to grip the line to the boat is apparent, according to a preferred embodiment of the present invention.
Figure 6A:
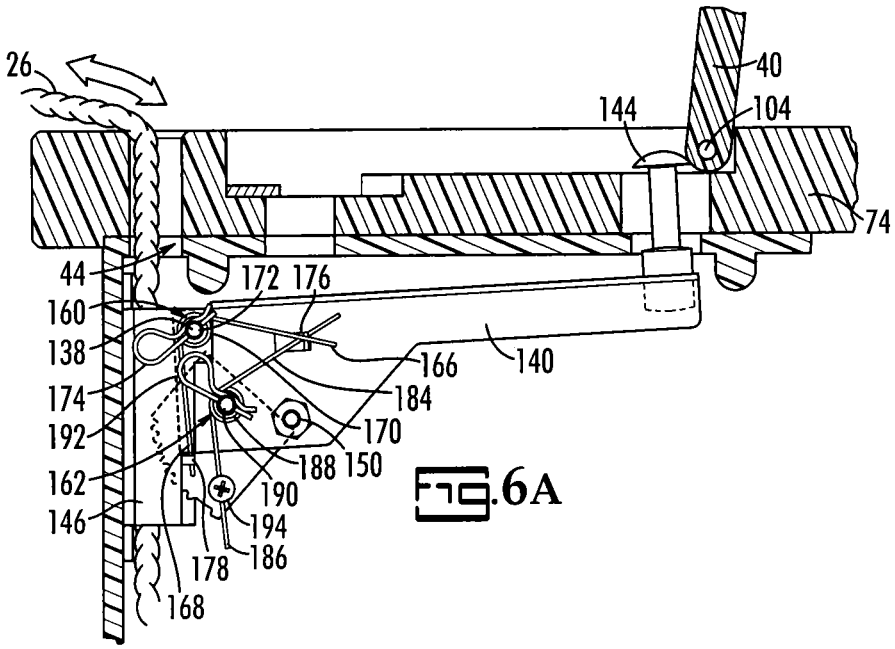
FIGS. 6A and 6B are right side, cross sectional views of a portion of the present tethering device with latch arm in the unlatched (raised) position and in the latched (lowered) position, according to a preferred embodiment of the present invention.
Figure 6B:
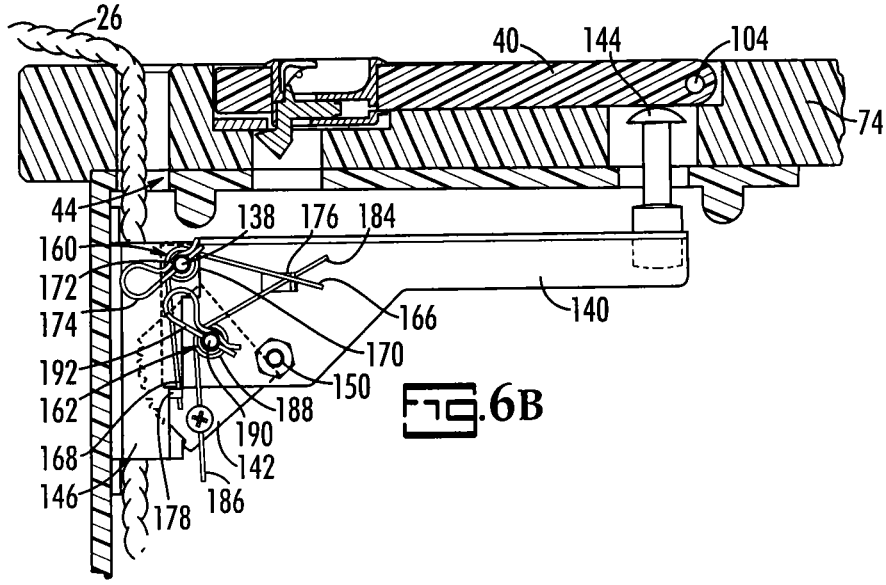

FIGS. 3, 4, 5A, 5B, 6A and 6B are cross sectional views of device 10. Reference numbers used in FIGS. 1 and 2 are used in FIGS. 3-6 for the same components for convenience. Also, for convenience, the views in FIGS. 3, 4, 5A and 5B are deemed left side views of device 10, from the perspective of someone standing on boat 12 and looking at device 10 on dock 14, as is the case in FIG. 1. FIGS. 6A and 6B show right side cross sectional views of device 10 from the same perspective.

Referring particularly to FIG. 3, an exploded view of device 10, and FIG. 4, a cross sectional view from the left side of device 10, housing 42 of device 10 includes removable left side 54 for providing access to the interior of housing 42 and held in place with screws 118. To the left of housing 42 is adaptor plate 70 that fits just under flanges 72 of housing 42. Flanges 72 may be approximately ¼ inch wide or a little wider. Dock board 74 is attached to adaptor plate 70 from below using bolts. Inside a recess 86 formed in dock board 74 is latch arm 40 with a latch 88. A hole 90 is formed in dock board for running end 30 of line 26 to exit device 10 and which hole 90 is in registration with hole 44 in housing 42. Hole 90 may be beveled to reduce wear on line 26 as line 26 is pulled from and retracts back into device 10.

Two other holes are formed in dock board 74, namely, a first hole 98 in the proximal end of recess 86 of dock board 74 that allows latch 88 on the end of latch arm 40 to communicate with the housing 42, and a second hole 102 on the distal end of recess 86 of dock board 74 that allows latch arm 40 to communicate with the interior of housing 42. Distal end of latch arm 40 is pivotally attached to the distal end of recess 86 of dock board 74 with a pivot pin 104. A small strike plate 106 is attached to the proximal end of recess 86 in dock board 74 with screws 64. A sliding catch 108 moves rearward and clear of strike plate 106 with latch 88 when latch 88 is pivoted, thereby unfastening latch 88 and latch arm 40, allowing it to be raised by pivoting it about pivot pin 104 to the unlatched, raised position. Similarly, latching arm 40 can be pivoted down until sliding catch 108 passes strike plate 106 and latch 88 can be pivoted closed, at which point, sliding catch 108 is slid forward to catch strike plate 106 and hold latch arm 40 secure to dock board 74. The structure and operation of latch arm 40 will be described in more detail below.

Inside housing 42 is a retraction reel 120 that retracts slack in line 26. Reel 120 has a circular cover plate 122 over a spool 124 rotatably mounted to an axle 126. An end of line 26 is secured to spool 124 and wound therearound. Running end 30 of line 26 passes around a post 128 close to the inside surface of proximal side 50 and below hole 44. Running end 30 extends through hole 44 and hole 90 in dock board 74. Loop 28 in running end 30 serves to prevent line 26 from being retracted by retraction reel 120 back into housing 42. Alternatively, a knot in running end 30 or an object to which running end 30 of line 26 is tied can serve the same purpose as long as the width of the knot or object is greater than the diameter of hole 90 so that running end 30 cannot be retracted back into device 10. Retraction is accomplished using a power coil spring 130 inside spool 124 that is loaded by the withdrawal of a length of line 26 and relieved when allowed to retract spring back onto spool 124.

Within housing 42 is a line locking system shown in FIG. 3 at the bottom right to allow the user to hold line 26 so that it does not retract running end 30 all the way back to dock board 74 but allows a user to pre-selected a length of line 26 to remain drawn from device 10. The line locking system includes principally a locking arm 140 pivotally carrying a toothed cam 142 on the end thereof, as best seen in FIGS. 3 and 4. Cam 142 has a surface treatment to increase friction between line 26 and cam 142 such as teeth as shown or knurling. FIGS. 5A and 5B show left side views with latch arm in the unlatched and latched positions, respectively; FIGS. 6A and 6B show right side views of latch arm in the unlatched and latched positions respectively. The operation of the line locking system components except for biasing springs are best seen in FIGS. 5A and 5B; the biasing springs are best seen in FIGS. 6A and 6B.

Referring now to FIGS. 5A, and 5B, locking arm 140 is pivotally mounted to housing 42 so that its proximal end carries toothed cam 142 and its distal end is positioned just below second holes 60 and 102 in housing 42 and in recess 86 of dock board 74, respectively. An activation rod 144 is carried by distal end of locking arm 140 so that it extends through holes 60 and 102 where latching arm 40 can engage it and, as latching arm 40 is moved from the unlatched (raised) position to the latched (lowered) position, latching arm 40 presses activation rod 144 down into housing 42 whereby it in turn pivots distal end of locking arm 140 counter-clockwise about a pivot pin 138 when viewed from the left side of device 10. The counter-clockwise pivoting of locking arm 140 pushes toothed cam 142 against line 26 to prevent further movement of line 26 as long as latch arm 40 is latched and activation rod 144 is pressed down. A stopper 150 carried by locking arm 140 limits the ability of toothed cam 142 to back away from line 26 even when latch arm 40 is in the unlatched position and line 26 is free to retract.

To assure that line 26 is always positioned so that it can be held by toothed cam 142, an arm mount 146 is affixed to the inside surface of proximal side 50. Arm mount 146 has two opposing flanges 148 that define a channel therebetween which channel is positioned so that line 26 runs directly through it, between opposing flanges 148, as line 26 passes around post 128 on its way to hole 44 in housing 42. Toothed cam 142, when moved by the pivoting of locking arm 140 to the latched (closes) position, rotates into the channel defined by arm mount 146 and against line 26.

Referring now to FIGS. 6A and 6B, the effect of certain biasing springs will now be described. There are two biasing springs, a return biasing spring 160 and a cam spring 162. Return biasing spring 160 urges locking arm 140 to rotate counter-clockwise when viewed from the right side of device 10 (clockwise when viewed from the left side) so that activation rod 144 is pushed up upon movement of latch arm 40 to the unlatched position. Conversely, closing latch arm 40 loads return biasing spring. Locking arm 140, aided by stopper 150, causes toothed cam 142 to pivot into the channel between opposing flanges 148 and against line 26 when latch arm 140 is closed while return biasing spring 160 pivots toothed cam 142 away from line 26 when latching arm 40 is moved to the unlatched position.

Return biasing spring 160 is a coiled spring with a first end 166 and an opposing second end 168 with coil 170 fixed into position by post 172 and a clevis pin 174 to hold it onto post 172. First end 166 engages a catch 176 carried on locking arm 140 and movable therewith, so that first end 166 moves with the movement of locking arm 140. As locking arm 140 is rotated clockwise (right view) about a pivot pin 138 by the downward movement of activation rod 144, return bias spring 160 is loaded against catch 178 on arm mount 146. Counter-clockwise rotation of locking arm 140 relieves return bias spring 160.

Cam spring 162 has a first end 184 and an opposing second end 186 with a coil 188 there between mounted on a post 190 and held to post 190 by a clevis pin 192. First end 184 of cam spring 162 is also operated against catch 176 and second end 186 is applied against post 194 so that cam spring is always urging toothed cam 142 out of the arm mount channel and away from line 26. Locking arm 140 and return biasing spring 160 ultimately control when toothed cam 142 is in channel. Also, when latch arm 40 is in the latched position, tension on line 26 will act on toothed cam 142 to further engage cam 142 against line 26, but when latch 40 is moved to the unlatched position, and locking arm 140 is moved away from line 26, cam spring 162 pulls toothed cam 142 from line 26.

Those familiar with docks and boating will appreciate that many modifications and substitutions can be made to the foregoing preferred embodiments of the present invention without departing from the spirit and scope of the present invention, defined by the appended claims.

What is claimed is:

1. A device for use with a dock having a frame with decking on said frame, said device comprising:

(a) a housing having a hole formed therein;

(b) a retraction reel rotatably mounted within said housing;

(c) a line having a running end and a fixed end, said fixed end attached to and wound onto said retraction reel, said running end of said line passing through said hole in said housing to the exterior of said housing;

(d) a latch arm carried by said housing, said latch arm having a latched position and an unlatched position;

(e) a locking arm pivotally mounted within said housing;

(f) a dock board carried by said housing, said dock board having a recess, said latch arm fitting within said recess, wherein said dock board has a hole formed therein and in registration with said hole in said housing for said line to pass therethrough; and (g) a cam pivotally carried by said locking arm and proximate to said housing, wherein, when said latch arm is moved to said latched position, said latch arm pivots said locking arm to drive said cam against said line to hold said line against said housing so that, when said device is attached to a frame of a dock and a boat is attached to said running end of said line, said boat cannot drift away from said dock.

2. The device as recited in claim 1, further comprising a spring that biases said locking arm to pull said cam away from said line when said latch arm is moved to said unlatched position.

3. The device as recited in claim 1, wherein said cam is formed to have teeth to grip said line.

4. The device as recited in claim 1, wherein said latch arm includes an activation rod and said locking arm has a distal end and a proximal end, said cam being carried by said proximal end, said activation rod engaging said distal end of said locking arm and pivoting said locking arm with said cam into engagement with said line when said latch arm is moved from said unlatched position to said latched position.

5. The device as recited in claim 1, wherein said retraction reel includes a power spring biasing said retraction reel to take up slack in said line.

6. The device as recited in claim 1, wherein said dock includes decking fastened to a frame, said decking having a surface and said dock board having a surface, and wherein said dock board is dimensioned to be flush with said decking when said dock board is attached to said housing and said housing is attached to said dock.

7. The device as recited in claim 1, wherein said hole is in said proximal end of said dock board so that said line can be extended from said device near the edge of said dock.

8. The device as recited in claim 1, wherein said locking arm further comprises an arm mount affixed to said housing, said arm mount pivotally holding said locking arm and channeling said line proximate to said cam.

9. The device as recited in claim 1, wherein said locking arm carries a stopper to limit pivoting of said cam.

10. A device for use with a dock having a frame with decking on said frame, said device comprising:

(a) a housing having a hole formed therein;

(b) a dock board carried by said housing and attachable to a dock, said dock board having a recess and a hole formed therein, said hole being in registration with said hole of said housing;

(c) a reel rotatably mounted within said housing;

(d) a line having a running end and a fixed end, said fixed end attached to and wound onto said reel, said running end of said line passing through said hole in said housing and said hole in said dock board to the exterior of said housing;

(e) a latch arm pivotally carried in said recess of said dock board, said latch arm having a latched position and an unlatched position;

(e) a locking arm pivotally mounted within said housing;

(f) an activation rod in operative connection with said latch arm and said locking arm, said activation rod pressing on said distal end of said locking arm when said latch arm is in said latched position and releasing said locking arm when said latch arm is in said unlatched position;

(g) a cam pivotally carried by said locking arm and proximate to said housing; and (h) an arm mount attached to said housing and adapted to channel said line proximate to said cam so that, when said latch arm is moved to said latched position, said latch arm, operating through said activation rod, pivots said locking arm to drive said cam against said arm mount in order to hold said line so that said boat cannot drift away from said dock.

11. The device as recited in claim 10, wherein said reel is a retraction reel to take up slack in said line.

12. The device as recited in claim 10, further comprising a spring that biases said locking arm to pull said cam away from said line when said latch arm is moved to said unlatched position.

13. The device as recited in claim 10, wherein said dock includes decking fastened to a frame, said decking having a surface and said dock board having a top surface, and wherein said dock board is dimensioned to be flush with said decking when said dock board is attached to said housing and said housing is attached to said dock.

14. The device as recited in claim 10, wherein said cam is formed to have teeth to grip said line.

15. The device as recited in claim 10, wherein said locking arm carries a stop pin to limit pivoting of said cam.

16. The device as recited in claim 10, further comprising an adaptor plate securing said dock board to decking of said dock so that said dock board is flush with said decking.

* * * * *